United States Patent [19]

Sack et al.

[11] Patent Number: 4,744,176

[45] Date of Patent: May 17, 1988

[54] NC-CONTROLLED EDGE GRINDING MACHINE

[75] Inventors: E. Theodor Sack, Ratingen-Hösel; Gottfried Strauss, Heiligenhaus; Klaus Glittenberg, Erkrath, all of Fed. Rep. of Germany

[73] Assignee: Glasstemp of Toledo, Inc., Perrysburg, Ohio

[21] Appl. No.: 801,297

[22] Filed: Nov. 25, 1985

[51] Int. Cl.[4] ..... B24B 49/00

[52] U.S. Cl. ..... 51/165.71; 51/101 R

[58] Field of Search ..... 51/165.71, 165 TP, 101 R

[56] References Cited

U.S. PATENT DOCUMENTS

| | | | |
|---|---|---|---|
| 3,344,559 | 10/1967 | Inaba et al. | 51/165 TP |
| 3,448,547 | 6/1969 | Rahrig et al. | 51/101 R |
| 4,274,231 | 6/1981 | Verega | 51/165.71 |
| 4,375,738 | 3/1983 | Bando | 51/165 TP |
| 4,434,582 | 3/1984 | Strass et al. | 51/101 R |

FOREIGN PATENT DOCUMENTS 0126038 11/1984 European Pat. Off. .

*Primary Examiner*—Harold D. Whitehead

*Attorney, Agent, or Firm*—Brooks & Kushman

[57] ABSTRACT

Glass-grinding machine for machining the edges of glass panes, particularly vehicle panes, constructional glass and furniture glass, with a turntable arranged with a vertical turning axis and exhibiting a clamping device for the positioned anchorage of each respective glass pane to be machined, with at least one grinding wheel arranged near the turntable circumference with a vertical axis of rotation, the relative position of which, with respect to the turntable axis, is automatically adjustable in conformity with the contour of the glass pane to be machined as a function of the turning position of the turntable, and with a charging device and a discharging device for the glass panes to be machined and having been machined respectively, characterized in that the grinding wheel (24, 26) is movable under numerical control as a function of the turntable position at least along an axis directed towards the turning axis (12) of the turntable (10). (FIG. 1).

4 Claims, 2 Drawing Sheets

NC-CONTROLLED EDGE GRINDING MACHINE

Figure 1:
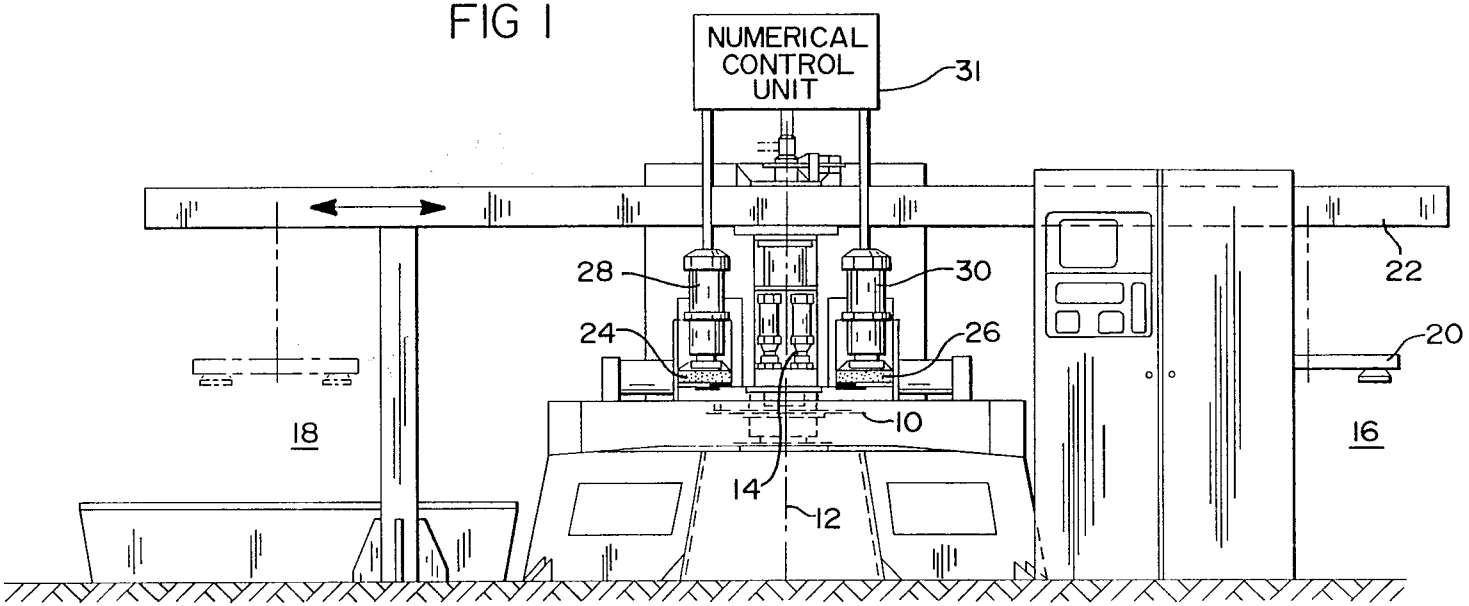

The invention relates to a glass-grinding machine for machining the edges of glass panes, particularly vehicle panes, constructional glass and furniture glass, with a turntable arranged with a vertical turning axis and exhibiting a clamping device for the positioned anchorage of each respective glass pane to be machined with at least one grinding wheel arranged near the turntable circumference with a vertical axis of rotation, the relative position of which, with respect to the turntable axis, is automatically adjustable in conformity with the contour of the glass pane to be machined as a function of the turning position of the turntable, and with a charging device and a discharging device for the glass panes to be machined and having been machined respectively.

Glass-grinding machines of the above-described type are used to an increasing extent for the automatic machining, particularly trimming, and grinding the edges of broken-off glass panes, particularly panes of vehicles. In the known glass-grinding machines the relative position of the circumference grinding wheel, or of the two circumference grinding wheels which are optionally provided, of which one performs the fine machining and the other the finish machining, relative to the turning axis of the turntable, which executes a revolution of slightly more than 360°, for example, for the purpose of machining a pane, is controlled as a function of the contour of the glass pane to be machined, in such a way that a template formed to correspond to the pane contour and arranged above or below the plane of the glass pane positioned on the turntable and to be machined, is sensed, whereby it is also ensured that the frequently very different radii of curvature of the particular pane contour to be machined can be taken into consideration by the circumference grinding wheel or circumference grinding wheels. Glass-grinding machines of this type have proved entirely satisfactory in practice, however it has been found disadvantageous that the described mode of template control involves a high outlaty for apparatus, and the conversion from one pane model to another occupies a great deal of time.

It is therefore the underlying aim of the invention to develop an automatically operating glass-grinding machine of the type in question, in which the control of the grinding wheels is effected more precisely and more simply than in the machines hitherto known.

This aim is achieved according to the invention in the case of a glass-grinding machine of the type initially defined, when the grinding wheel is movable under numerical control as a function of the turntable position at least along an axis directed towards the turning axis of the turntable.

A preferred embodiment of the invention provides that the grinding wheel is movable under numerical control as a function of the turntable position exclusively along an axis directed towards the turning axis of the turntable.

Particularly, two or more grinding wheels movable under numerical control may also be provided.

Furthermore, the invention proposes that the two grinding wheels, if present, are arranged mutually staggered at an acute angle relative to the turntable circumference.

As a further development of this embodiment, it may be provided that the two grinding wheels are arranged mutually staggered at an angle of 50° relative to the turntable circumference.

A further embodiment of the invention is characterized in that the speed of rotation of the grinding wheels is controllable as a function of the turning position of the turntable.

It may then be provided that the speed of rotation of the grinding wheel is controllable as a function of the turning speed of the turntable.

It is therefore characteristics of the invention that the template control hitherto customary and considered indispensible for the circumference grinding wheels is entirely abandoned and is replaced by a numerically controlled movement thereof. The processor, the signal devices and indicator devices and the necessary control elements are then housed in a control cabinet associated with the grinding machine. In the case of the embodiment specially preferred in practice, the grinding wheels are respectively rotatable by means of a drive motor, the number of revolutions of which may be regulable as a function of the turning position and of the turning speed of the turntable. The two grinding wheels which are preferably provided are then respectively movable along an axis directed towards the turning centre or the turning axis of the turntable under numerical control both as regards their position and also as regards their speed of travel. By the co-operation of the above-described features it is ensured that a precise machining of the pane edges occurs with optimum consideration of the respective pane contours et cetera as an absolute function of the contours of the pane to be machined without undue stressing of the pane edges and of the sensitive grinding wheels. The fixed and movable positioning cylinders are likewise adjustable under CNC control, or may be omitted if an external positioning means of the pane is provided.

Figure 2:
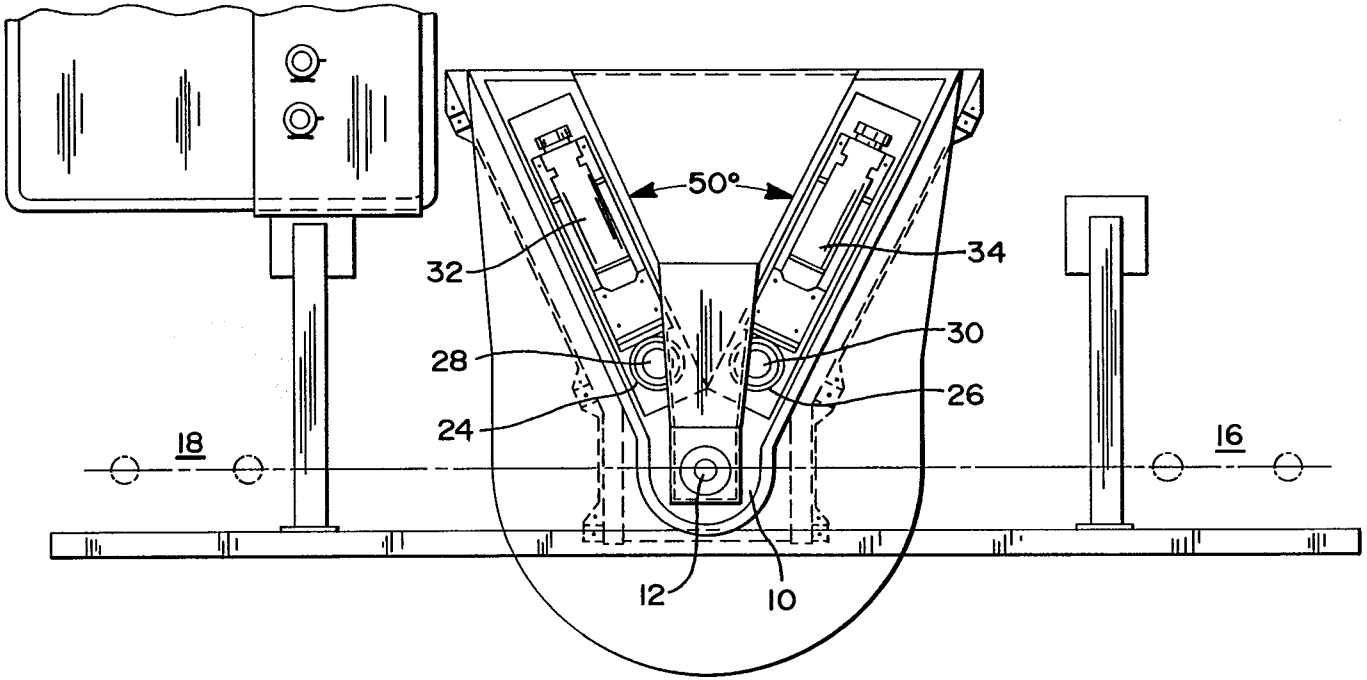

Further features and advantages of the invention appear from the following description, in which an exemplary embodiment is explained in detail with reference to the diagrammatic drawing, wherein:

FIG. 1 shows an exemplary embodiment of a glass-grinding machine according to the invention in side elevation, partly sectioned; and FIG. 2 shows the exemplary embodiment of FIG. 1 in plan, likewise partly sectioned.

As the drawing shows, the glass-grinding machine exhibits, in the exemplary embodiment illustrated, a turntable 10 with a vertical turning axis 12. A clamping device 14 with two raisable and lowerable rams, which is associated with the turntable 10, permits the precise, positioned anchorage of a glass pane, deposited on the turntable 10 for machining. The glass panes to be machined are removed in a charging station 16 from a first conveyor, as seen on the right in FIG. 1, whereas the glass panes which have been machined are deposited, in a discharging station 18 as seen on the left in FIG. 1, upon a second conveyor and transported away by the latter. The lifting of the glass panes from the first conveyor in the charging station 16 occurs by means of a known carriage 20 exhibiting a corresponding suction device or the like, to which a corresponding carriage associated with the discharging station 18 is rigidly connected, the carriages being guided on a carriage beam 22 and movable automatically in the direction of the arrow in FIG. 1, top left.

The drawing further shows that two grinding wheels 24, 26, which are rotatable by means of regulable drive motors 28, 30, are associated with the turntable 10, mutually staggered at 50° relative to its circumference. The drive motors 28, 30 with the grinding wheels 24, 26 operatively associated with them are movable under numerical acontrol, by numerical control unit 31, both relative to their position and also relative to their speed of travel along the axes directed towards the turning axis 12 of the turntable 10 by means of special servo-drives 32, 34. The speeds of rotation of the grinding wheels 24, 26 are also regulable in conformity with the turning position and the turning speed of the turntable 10, preferably as a function of a CNC control system.

The above-described glass grinding machine operates in the following manner:

A glass pane to be machined which has been picked up by the carrige 20 in the charging station 16 is deposited positioned on the turntable 10 and anchored on the latter by means of the clamping device 14. After the circumference grinding wheels 24, 26 have been moved into their initial work position, the turntable 10 begins to turn through a total of a full revolution (360° plus 1.5° overrun), whilst the two grinding wheels 24, 26 fine trim and/or grind all the edges of the glass pane to be machined. The coarse grinding is performed by one of the grinding wheels, whereas the other grinding wheel undertakes the fine machining, the latter performing the entire machining during the first 50° of the turntable turn, naturally due to the described arrangement of the circumference grinding wheels 24, 26, namely staggered at 50° relative to the circumference of the turntable 10. As a function of the contour of the glass pane to be machined, that is to say taking into consideration the pane corners et cetera, the speeds of rotation both of the turntable 10 and of the circumference grinding wheels 24, 26, and also the linear movement of the grining wheels 24, 26 along the axes directed toward the turning axis 12 of the turntable 10, are controlled as to position and as to speed, whilst a programme corresponding to the contour of the glass pane ensures a correct travelling of the pane shape. The division of a revolution of the turntable 10 into freely selectable sectors makes it possible, with the numerical control unit 31 adopted, to regulate the circumferential speed of the glass pane to be machined in conformity with the pane shape, whichever of the circumference grinding wheels 24, 26 is nearer to a pane corner, in the case of asummetrical glass formats, determining the speed. Obviously, a constant turning speed of the turntable 10 can also be programmed, indeed the numerical control unit 31 adopted according to the invention provides the widest flexibility in the planning of the grinding programme.

After the glass pane anchored on the turntable 10 by means of the clamping device 14 has been finally machined, after releasing the clamping device 14, the pane is lifted off the turntable by means of a discharging carriage connected firmly to the above-described carriage 20 and deposited in the discharging station 18 upon the second conveyor, whereupon the glass pane having been machined is transported away to the left as seen in FIG. 1, whilst the next glass pane to be machined is automatically picked up in the charging station 16 and positioned on the turntable 10. The apparatus operates fully automatically in the above-described manner.

The features of the invention disclosed in the above description, in the Claims and in the drawing may, both individually and also in any desired combinations, be essential to the realisation of the invention in its various embodiments.

We claim:

1. Glass-grinding machine for machining the edges of glass planes, particularly vehicle panes, construction glass and furniture glass, with a turntable arranged with a vertical turning axis and exhibiting a clamping device for the positioned anchorage of each respective glass pane to be machined, with at least two grinding wheels arranged near the turntable circumference with a vertical axis of rotation, the relative position of which, with respect to the turntable axis, is automatically adjustable in conformity with the contour of the glass pane to be machined as a function of the turning position of the turntable, and with a charging device and a discharging device for the glass panes to be machined and having been machined respectively, characterised in a means mounting each of said two grinding wheels for movement along an axis directed toward the turning axis of said turntable, numerical control means for controlling said movement along said axis as a function of said turntable position, said mounting means being arranged staggered at an acute angle relative to said turntable circumference and to each other.

2. Glass grinding machine according to claim 1, characterised in that the two grinding wheels are arranged mutually staggered at an angle of 50° relative to the turntable circumference.

3. Glass-grinding machine according to claim 1 characterised in that the speed of rotation of the grinding wheels are controllable as a function of the turning position of the turntable.

4. Glass-grinding machine according to claim 3, characterised in that the speed of rotation of the grinding wheels are controllable as a function of the turning speed of the turntable.

* * * * *